US006030665A

United States Patent [19]

Simonsson

[11] Patent Number: 6,030,665

[45] **Date of Patent: *Feb. 29, 2000**

[54] METHOD AND A DEVICE FOR APPLICATION OF POWDER ON A CABLE

[75] Inventor: Lars Simonsson, Skärhamn, Sweden

[73] Assignee: Nordson Corporation, Westlake, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/849,033

[22] PCT Filed: Nov. 9, 1995

[86] PCT No.: PCT/SE95/01327

§ 371 Date: Jun. 9, 1997

§ 102(e) Date: Jun. 9, 1997

[87] PCT Pub. No.: WO96/14937

PCT Pub. Date: May 23, 1996

[30] Foreign Application Priority Data

Nov. 9, 1994 [SE] Sweden ..... 9403862

[51] Int. Cl.[7] ..... B05D 1/04; B05B 5/047

[52] U.S. Cl. ..... 427/479; 427/482; 427/485; 427/486; 118/629; 118/634

[58] Field of Search ..... 427/459, 471, 427/475, 482, 486, 479; 118/625, 627, 629, 630, 632, 634, 326, 316, 633; 174/118; 361/227

[56] References Cited

U.S. PATENT DOCUMENTS

| | | | |
|---|---|---|---|
| 2,657,339 | 10/1953 | Hampf . | |
| 2,781,280 | 2/1957 | Miller . | |
| 3,598,626 | 8/1971 | Probst et al. | 427/478 |
| 4,357,900 | 11/1982 | Buschor . | |
| 4,597,534 | 7/1986 | Ruud . | |
| 5,196,456 | 3/1993 | Nguyen et al. . | |

OTHER PUBLICATIONS

"The Science of Powder Coatings", Bate et al., vol. 2, pp. 69–71, 1994.

*Primary Examiner*—Fred J. Parker
*Attorney, Agent, or Firm*—Rankin, Hill, Porter & Clark LLP

[57] ABSTRACT

The invention concerns a method and a device for application of talcum powder of a super-absorbent powder (SAP) type or the like, the latter containing polyacrylate and/or a salt, such as a sodium salt, on a strip, such as a power cable. In accordance with the invention, the strip is made to travel through a treatment chamber in which debouch a number of powder supply lines distributed circumferentially with respect to said strip. The powder supply lines are incorporated in a friction charger formed with polarizing ducts through which the powder material is made to pass.

24 Claims, 1 Drawing Sheet

METHOD AND A DEVICE FOR APPLICATION OF POWDER ON A CABLE

BACKGROUND OF THE INVENTION

The subject invention concerns a method of applying talcum powder or a powder of super-absorbent type (SAP) or the like, the latter comprising polyacrylate and/or a salt, such as a sodium salt, on a strip, e.g. a power cable.

BRIEF SUMMARY OF THE INVENTION

The main purpose of the invention is to provide a method and a device for efficient application of such powders on the strip in question.

Surprisingly, it has been found that said powders may be very efficiently applied on the strip in question, which could e.g. be a power cable, on which the talcum serves as a lubricant between two insulating layers, and a primarly purpose of the super-absorbent powder is to absorb liquid upon damages to the cable cover and on account of the swelling caused thereby to form a seal at the site of the rupture with the aid of a friction charger wherein polarizing ducts are used through which the powder material is made to pass. In this case, the ducts emanating from the friction charger debouch into a treatment chamber through which the strip to be treated is made to pass. The mouths of the ducts into the treatment chamber are distributed circumferentially with respect to said strip in such a manner that charged powder moves towards said strip from several directions simultaneously.

Further characteristics of the invention will appear from the dependent claims.

BRIEF DESCRIPTION OF THE DRAWINGS

One embodiment of the invention will be described in the following with reference to the accompanying drawing, wherein.

DETAILED DESCRIPTION OF THE PREFERRED EMBODIMENT

Figure 2:
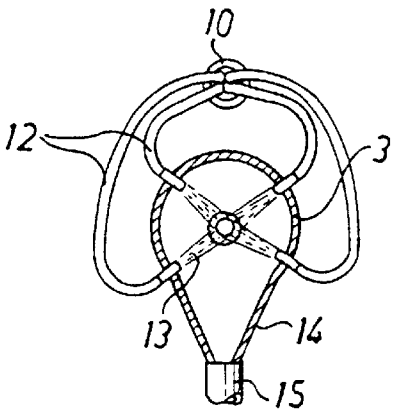
Figure 1:
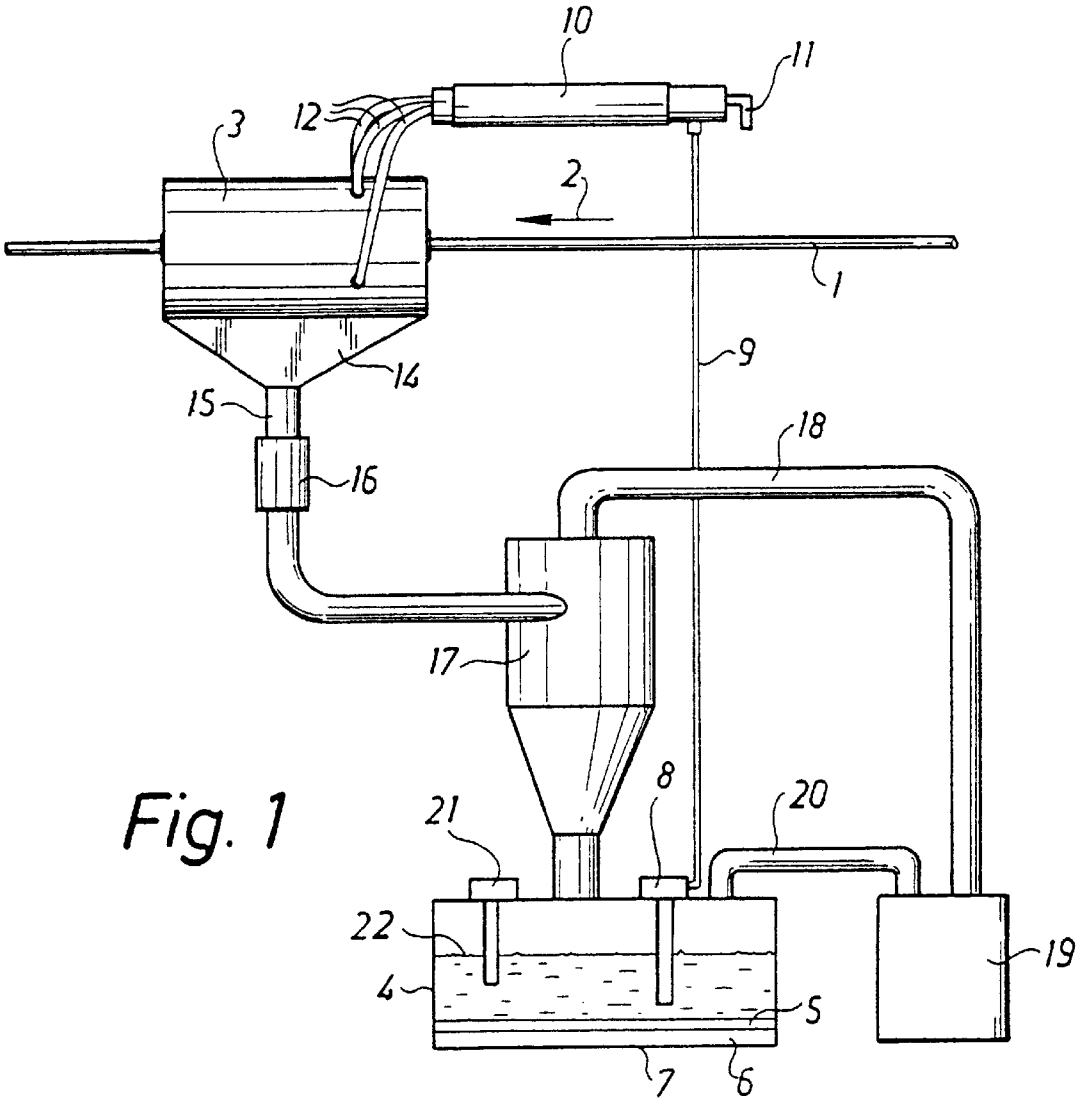
FIG. 1 is a schematical view of an installation in accordance with the invention, and FIG. 2 likewise is a schematical representation in cross-sectional view of a part of the installation, viz. through the treatment chamber in which powder material is applied on a strip passing through the chamber.

In FIG. 1 numeral reference 1 is used to designate a movable strip being advanced in the direction of arrow 2. The advancement could be continuous or intermittent. In accordance with the embodiment illustrated the strip 1 is a metal conductor for a power cable. Numeral reference 3 designates a treatment chamber which preferably abuts tightly against the strip 1 at its two ends, for instance with the aid of bristled through-apertures. Numeral reference 4 designates a supply container holding the powder material to be applied on the strip 1. The material in question is of talcum powder type or a super-absorbent powder (SAP) or the like. The latter material contains polyacrylate and/or a salt, such as a sodium salt. The sodium salt may contain polyacrylate. Preferably, the powder is maintained in a fluidized state inside the supply container by admission of air or other gas through a perforated inner bottom wall 5. Prior to its passage through the interior bottom wall the gas is distributed via an intermediate space 6 between the interior bottom wall 5 and the outer bottom wall 7 of the container. Numeral reference 8 designates a powder pump which is connected to a friction charger 10 via a powder supply line 9. The friction charger 10, which could e.g. be configured as disclosed in Applicants' U.S. Pat. No. 4,597,534, is formed with a connection 11 for inlet of air or other propelling gas for the purpose of forcing the powder through the charging ducts provided in the friction charger. The friction charging ducts inside the friction charger 10 communicate with mouths or nozzles 13 positioned in the treatment chamber 3, by way of prolongation lines 12. The ducts inside the friction charger 10 are polarized in such a manner that they impart the desired charge to the powder material passing through the charger. When the powder is a talcum powder, the ducts preferably consist of polytetrafluoroethylene, otherwise they preferably are of nylon, but also other materials providing a negative charge, such as e.g. polyethylene plastic, are conceivable in the latter case as also other materials which like tetrafluoroethylene give a positive charge with respect to talcum. The lower part of the treatment chamber 3 is structured as a collection funnel 14 the bottom part of which is connected to a return line 15 which by way a propelling device 16, for instance an ejector, is in communication with a separator 17, for instance cyclone filter. The separator 17 opens into the storage container 4 and also communicates with an outlet line 18 leading to the exterior by way of a filtering device 19. In addition, the supply container is connected to the filtering device 19 by way of a venting line 20. Numeral reference 21 designates a level controller by means of which the desired level 22 of the material is maintained inside the storage container. Devices for replenishing of new powder material are also connected to the container. These devices are not, however, illustrated in the drawing. Preferably, the friction ducts of charger 10 are grounded as is also strip 1.

The illustrated device functions in the following manner. The powder material fluidized inside the storage container 4 is fed by the pump 8 and via the interconnection line 9 to the friction charger 10, wherein the powder material is imparted a negative charge through friction against the elongate ducts therein. The powder material exiting from the ducts mouths 13 is attracted to the strip 1 and remain thereon, also after the strip has passed through the treatment chamber 3. Superfluous powder material is conducted via line 15 through an accelerating ejector 16 at a high velocity into the separator 17, which in the embodiment illustrated is constructed as a cyclone filter. In other words, the powder material is imparted a swirling movement inside the cyclone, whereby the powder material slides downwards along the external wall of the cyclone separator into the storage container for recirculation via the connection line 9, the friction charger 10 and so on.

The invention has been described in the aforegoing by way of one example according to which the interior threads of a power line are coated with the referred-to liquid-absorbent powder material prior to the application of a further insulating layer. However, it is likewise possible to use the invention in other contexts involving application of the powder material in question. In case the strip in question is not conductive, grounding may still be effected by guiding the strip by or supporting it on carriers that in turn are conductive. Talcum preferably is applied between two sandwiching insulating layers in order to facilitate peeling of the outer layer from an interior layer. In this case, the talcum serves as a lubricant. The cyclone may be omitted.

The chemical composition of talcum is $Mg^3(OH_2)\ Si^4O^{10}$, and examples of compositions that have proved to be particularly suitable are:

| I | |
|---|---|
| $SiO_2$ | 59% |
| MgO | 31.50% |
| $Fe_2O_3$ | 1.10% |
| $Al_20_3$ | 1.90% |
| CaO | 0.60% |
| pH-value | 9.30% |
| **II** | |
| $SiO_2$ | 52% |
| MgO | 30.80% |
| $Fe_2O_3$ | 2.80% |
| CaO | 0.90% |
| $Al_20_3$ | 5.40% |
| $Na_2O$ | 0.05% |
| $K_2O$ | 0.10% |
| $TiO_2$ | 0.30% |
| $H_2O + CO_2$(1050° C.) | 8% |
| pH-value, DIN 53200 | 8.50% |

Although testing has shown that these compositions are very efficient, the composition may naturally be changed without departure from the inventive idea.

I claim:

1. A method of applying powder, on a power cable, comprising the steps of:

bringing the cable to travel through a treatment chamber in which debouch a plurality of powder supply lines distributed circumferentially with respect to said cable, passing said powder through a single friction charger formed with polarizing ducts in order to impart a charge to said powder, and introducing said powder into said chamber from said friction charger through said powder supply lines, said friction charger being connected to said plurality of powder supply lines.

2. A method as claimed in claim 1, wherein the cable as well as the ducts in the friction charger are electrically grounded.

3. A method as claimed in claim 1, the powder being a super-absorbent powder (SAP) containing polyacrylate and/or a salt, wherein the ducts are chosen to be negatively polarizing.

4. A method as claimed in claim 2, wherein a nylon material or a polyethylene material is chosen for the ducts in the friction charger.

5. A method as claimed in claim, 1, wherein the powder is talcum, and wherein the ducts are chosen to be positively charged.

6. A method as claimed in claim 5, wherein polytetrafluoroethylene is chosen for the ducts of the friction charger.

7. A device for applying talcum powder or a super-absorbent powder (SAP), the latter containing polyacrylate and/or a salt, on a strip, the device comprising:

a treatment chamber through which the strip is conveyed, a plurality of nozzles distributed circumferentially with respect to the strip through which said powder is introduced into said chamber, a plurality of powder supply lines each of which is connected to supply powder to one of said nozzles, and a single friction charger having polarizing ducts and connected to supply powder to said plurality of nozzles through said powder supply lines.

8. A device as claimed in claim 7, comprising in addition means for electrically grounding the strip as well as the ducts in the friction charger.

9. A device as claimed in claim 7, wherein the powder is a super-absorbent powder containing polyacrylate and/or a salt, comprising in addition means for negatively polarizing the ducts.

10. A device as claimed in claim 9, wherein the ducts in the friction charger comprise nylon or polyethylene material.

11. A device as claimed in claim 7, wherein the powder is talcum, comprising in addition means for positively polarizing the ducts in the friction charger.

12. A device as claimed in claim 11, wherein the ducts of the friction charger comprise polytetrafluoroethylene.

13. A method of manufacturing cable in which the cable is coated with a powder, comprising the steps of:

providing a treatment chamber having a central axis with a plurality of nozzles distributed circumferentially around the axis, each of the nozzles directing a spray of powder generally radially toward the axis;

moving the cable through the treatment chamber along the axis whereby powder from the nozzles sprays onto the cable;

charging the powder using a single friction charger, the friction charger being formed with polarizing ducts through which the powder material passes and is electrically charged thereby, the friction charger connected to supply charged powder to a plurality of powder supply lines; and supplying each of the nozzles with charged powder through the plurality of powder supply lines, each of the powder supply lines supplying charged powder to one of the nozzles.

14. A method as claimed in claim 13, wherein the cable and the ducts of the friction charger are electrically grounded.

15. A method as claimed in claim 13, wherein the powder is a super-absorbent powder containing polyacrylate and/or a salt, and the ducts of the friction charger are made of a material which provides a positive charge to the powder.

16. A method as claimed in claim 13, wherein the powder is talcum, and the ducts of the friction charger are made of a material which provides a negative charge to the powder.

17. A method as claimed in claim 16, wherein the ducts of the friction charger are made of a nylon material or a polyethylene material.

18. A method as claimed in claim 15, wherein the ducts of the friction charger are made of polytetrafluoroethylene.

19. Apparatus for coating a cable with talcum powder or with a super-absorbent powder containing polyacrylate and/or a salt, comprising:

a treatment chamber through which the cable is conveyed;

a plurality of nozzles which extend into the chamber for spraying the powder onto the cable, the nozzles being distributed circumferentially with respect to the cable, a plurality of powder supply lines each of which is connected to one of the nozzles to supply powder to the nozzle; and a single friction charger connected to supply charged powder to the plurality of powder supply lines, the friction charger having polarizing ducts which provide an electrical charge to the powder.

20. Apparatus as claimed in claim 19, comprising in addition means for electrically grounding the cable, and wherein the friction charger includes means for electrically grounding the ducts in the charger.

21. Apparatus as claimed in claim 19 for coating the cable with powder which is a super-absorbent powder containing polyacrylate and/or a salt, wherein the friction charger includes means for negatively polarizing the ducts.

22. Apparatus as claimed in claim 21, wherein the ducts in the friction charger comprise nylon or polyethylene material.

23. Apparatus as claimed in claim 19 for coating the cable with powder which is talcum, wherein the friction charger includes means for positively polarizing the ducts.

24. Apparatus as claimed in claim 23, wherein the ducts of the friction charger comprise polytetrafluoroethylene.

* * * * *